US008505722B1

(12) United States Patent
Butruille et al.

(10) Patent No.: US 8,505,722 B1
(45) Date of Patent: Aug. 13, 2013

(54) STACKABLE PALLET CONTAINER

(71) Applicants: Thibaut Butruille, Petersbach (FR); Hubert Willig, Sarreguemines (FR)

(72) Inventors: Thibaut Butruille, Petersbach (FR); Hubert Willig, Sarreguemines (FR)

(73) Assignee: Soltralentz Packaging S.A.S., Drulingen (FR)

( * ) Notice: Subject to any disclaimer, the term of this patent is extended or adjusted under 35 U.S.C. 154(b) by 0 days.

(21) Appl. No.: 13/753,563

(22) Filed: Jan. 30, 2013

(30) Foreign Application Priority Data

Jan. 31, 2012 (DE) ..... 10 2012 100 801

(51) Int. Cl.
*B65D 19/00* (2006.01)

(52) U.S. Cl.
USPC ..... 206/386

(58) Field of Classification Search
USPC ..... 206/386, 598, 503; 220/9.1, 9.4, 220/495.01
See application file for complete search history.

(56) References Cited

U.S. PATENT DOCUMENTS

| | | | | |
|---|---|---|---|---|
| 5,655,679 | A | 8/1997 | Schutz | |
| 5,704,477 | A * | 1/1998 | Hermann et al. | 206/386 |
| 6,202,844 | B1 * | 3/2001 | Sedlmayr | 206/386 |
| 7,140,490 | B2 | 11/2006 | Przytulla | |
| 2005/0145521 | A1 * | 7/2005 | Perkins | 206/386 |
| 2011/0073510 | A1 * | 3/2011 | Cassina | 206/386 |

FOREIGN PATENT DOCUMENTS

| | | | |
|---|---|---|---|
| DE | 19503043 | A | 6/1996 |
| DE | 10002610 | A | 8/2001 |

* cited by examiner

*Primary Examiner* — Jacob K Ackun
(74) *Attorney, Agent, or Firm* — Andrew Wilford

(57) ABSTRACT

A stackable pallet container for transporting or storing fluent material has a rigid pallet, a plastic liner bag sitting on the pallet, and a mesh outer jacket surrounding the plastic liner bag, secured to the pallet, and forming with the pallet an upwardly open cavity containing the liner bag. The jacket is formed by horizontal rods and vertical rods joined at crossings. At least partially U-section vertical reinforcement bars are fixed inside the outer jacket and each have an upper end formed on a side directed inward toward the bag with a cutout.

20 Claims, 6 Drawing Sheets

9a
9a"
9a'
14
E
α
h
9
12
9b
9b

STACKABLE PALLET CONTAINER

FIELD OF THE INVENTION

The present invention relates to a stackable pallet container.

BACKGROUND OF THE INVENTION

A typical stackable pallet for transporting and/or storing fluent and/or pourable bulk material comprises a pallet, a plastic liner bag on the pallet, and a mesh outer jacket that surrounds the plastic liner bag and that is formed by horizontal rods and vertical lattice rods connected with one another at crossings and forming a lattice. The mesh outer jacket is provided with vertically extending reinforcements preferably formed by prefabricated U-section profiles that project inward toward the liner bag and are open toward the outside and that are attached to side walls formed by the mesh jacket.

Such a pallet container generally has a rectangular footprint and serves for transporting and storing fluent and/or pourable bulk material. The plastic liner bag is generally produced by blow-molding. It can have a holding capacity of more than 500 liters, for example about 1000 liters. Depending on the density of the contained material, this results in a total load of a ton and more. The pallet container furthermore is generally stackable, i.e. the pallet of an upper pallet container sits on the upper edge of the mesh jacket of an underlying pallet container. Particularly in the filled state, the plastic liner bag supports itself on the mesh outer jacket, so that the mesh outer jacket is subjected to increasing stress with increasing load, which can lead to disruptive bulging. On the other hand, the filled pallet containers stand tightly against one another during transport and in the warehouse. In this case, bulging would be a problem.

For this reason, it has already been proposed to mount prefabricated reinforcement U-section profile bars that have attachment flanges at the ends of the U-legs on the regions of the side walls that are at risk of bulging. Such a stackable pallet container of the type described above is known from DE 195 03 043. The reinforcement profiles can be made of sheet steel and can be welded onto the round steel rods of the side walls. These reinforcement profiled extend vertically.

Alternatively, it has been proposed to form vertically extending reinforcements in the mesh outer jacket. For example, a stackable pallet container of the type described above is known from DE 100 02 610 where the horizontal lattice rods are formed into vertical and horizontally spaced reinforcement formations projecting inward toward the plastic container, and the reinforcement formations are aligned vertically to form outwardly open reinforcement grooves that receive on the outside respective vertical lattice rods, with other vertical lattice rods on the inside flanking each such groove. The plastic liner bag can be provided with corresponding molded parts into which the reinforcement grooves engage. With such reinforcement measures, it is possible to effectively prevent bulging of the container.

Furthermore, pallet containers having liner bags and outer jackets are known, where the outer jacket is formed by lattice tube frames, so that the vertical and horizontal lattice rods are formed by tubular rods, which are also welded to one another at crossings. Such tubular rods can have the most varied profiles. For example, it has already been proposed to produce the vertical and/or horizontal tubular rods from open profiles having a trapezoid cross-section (see for example U.S. Pat. No. 7,140,490).

Finally, a pallet container having a lattice outer jacket is known from U.S. Pat. No. 5,655,679, in which stabilization is supposed to be achieved by four corner supports made of steel, having an angled profile.

The known pallet containers have basically proven themselves in practice, but they are capable of being improved.

OBJECTS OF THE INVENTION

It is therefore an object of the present invention to provide an improved pallet container for bulk material.

Another object is the provision of such an improved pallet container for liquids or bulk material that overcomes the above-given disadvantages, in particular that is characterized by great stability and simple and cost-effective manufacture, without stackability of the pallet container being impaired.

SUMMARY OF THE INVENTION

A stackable pallet container for transporting or storing fluent material has according to the invention a rigid pallet, a plastic liner bag sitting on the pallet, and a mesh outer jacket surrounding the plastic liner bag, secured to the pallet, and forming with the pallet an upwardly open cavity containing the liner bag. The jacket is formed by horizontal rods and vertical rods joined at crossings. At least partially U-section vertical reinforcement bars are fixed inside the outer jacket and each have an upper end formed on a side directed inward toward the bag with a cutout.

In this connection, the invention proceeds, first of all, from what is known from DE 195 03 043 A1, that bulging can be reliably prevented if the mesh outer jacket is made with vertically extending reinforcement grooves on its side surfaces, which grooves are not formed into the mesh jacket, but rather are produced as separate reinforcement profiles, in an embodiment as U-section profiles, and are welded to the actual lattice jacket and therefore to the lattice structure. This has the advantage that for one thing, great stability is achieved by the additional reinforcement profiles, but for another thing, production is simplified, because the mesh jacket itself can be produced from planar mesh mats, for example steel lattice mats, without reinforcement profiles having to be formed into these mats. At the same time, the stability of the lattice jacket and therefore the stability of the entire pallet container can be improved by the U-section profiles. In the case of such a pallet container having reinforcement profiles, it is now guaranteed, by the cutout at the upper end of the reinforcement profile, according to the invention, that the stackability of the pallet container is not impaired. This is because it is basically practical if the reinforcement profiles extend over the entire height of the mesh jacket, so that they preferably extend all the way to the upper and lower end rods of the mesh jacket and can also be connected to these end rods, for example. Nevertheless, a further pallet can easily be set onto such a mesh jacket and consequently such a pallet container, so that the pallet containers can be stored and transported in a stack, partially nested. The cutouts according to the invention guarantee that the pallet positioned on the mesh jacket can essentially extend down into the mesh jacket underneath, so that secure positioning is guaranteed. In this connection, the cutouts can be configured stepped, for example. Preferably, however, the cutout of a reinforcement profile is formed by a recess that drops smoothly and continuously toward the liner bag.

These cutouts can be produced in simple manner, without the stability of the reinforcement profiles being overly impaired. Nevertheless, the cutouts create sufficient room for the upper pallet of the next pallet container to be set onto the mesh jacket. Such a cutout, for example a cutout, preferably has a vertical height of 10 mm to 100 mm, preferably 20 mm to 60 mm, for example about 40 mm. In this connection, the cutout can run at an angle of about 30° to 80°, for example about 40° to 70°, relative to the horizontal. In practice, for example, an angle of 50° to 60°, preferably about 55°, is used.

Preferably, the reinforcement profiles configured as U-section profiles are attached to the mesh jacket on the inside, for example welded to the horizontal lattice rods on the inside of the mesh outer jacket. In this connection, it is practical if the mesh outer jacket is formed from horizontal and vertical lattice rods, and the vertical lattice rods run on the inside, for example, and the horizontal lattice rods run on the outside, for example. The vertical lattice rods extend at least in part over the entire height of the mesh outer jacket. The horizontal lattice rods run over the entire circumference, as circumferential rods, and consequently over all four side walls of the container. An upper circumferential horizontal lattice rod and a lower circumferential horizontal lattice rod generally form the upper and the lower end of the lattice jacket, in each instance, where these upper and lower horizontal end rods can have an enlarged cross-section as compared with the other horizontal rods.

In any case, simple steel lattice mats having solid lattice rods can be used for the production of the mesh jacket according to the invention, so that it is possible to do without the use of tubular rods, in particular.

The horizontal and/or the vertical lattice rods preferably have a diameter of 4 mm to 8 mm, for example a diameter of 5 mm to 6 mm. The upper and lower end rods can have an enlarged diameter, in comparison, of 6 mm to 10, for example, about 8 mm, for example.

The U-section profiles are preferably produced from metal, for example sheet metal having a thickness of more than 0.5 mm, for example 0.5 mm to 2 mm, preferably 0.5 mm to 1 mm, for example about 0.8 mm.

Taking into consideration the fact that basically, plastic liner bags having groove-like molded-in parts are known, the possibility exists, within the scope of the invention, that the groove-shaped reinforcement profiles engage into these groove-shaped molded-in parts. In this connection, the mesh outer jacket according to the invention, having the groove-shaped reinforcement profiles, can basically be combined with known plastic liner bags. However, it also lies within the scope of the invention to specifically adapt the mesh outer jacket and the plastic liner bag to one another.

In any case, it is practical if the groove-shaped reinforcement profiles are attached to the mesh jacket in such a manner that the U-section profiles are open toward the outside, so that the grooves project in the direction toward the plastic liner bag and preferably engage into groove-shaped molded-in parts of the plastic liner bag. However, they can also support themselves on a plastic liner bag having planar side surfaces.

Basically, a mesh jacket can be used in which the horizontally running lattice rods are equidistant. It is practical that the U-section profiles are positioned between two adjacent vertical lattice rods. Preferably, however, a mesh jacket is used in which the vertical lattice rods are not equidistant. For example, the mesh jacket can have first regions that lie next to one another, distributed over the circumference, in which regions the vertically extending lattice rods have a small spacing, and second regions in which the vertical lattice rods have a large spacing that is greater than the small spacing. In the design of the mesh mat from which the mesh jacket is produced, the fact is consequently taken into account that the vertical U-section profiles according to the invention are between two vertical lattice rods in specific regions, so that in these regions, the vertical lattice rods have a greater spacing from one another. For example, it can be practical that the large spacing amounts to at least twice the small spacing, preferably about three times this spacing a. In this connection, the U-section profiles can have a total width that approximately corresponds to the small spacing between the vertical lattice rods.

These thoughts with the different regions having a different spacing between the vertical lattice rods take the fact into account that—after the U-section profiles have been attached to the lattice structure—an essentially uniform structure is formed. The open surface area spanned by the individual lattice openings are all smaller than 100 $cm^2$. Even if lattice mats having the larger spacing are produced during the course of production, after installation of the U-section profiles the remaining open surface area of the individual lattice openings is less than 100 cm2, so that in total, a stable structure is created.

In a preferred further development, the U-section profiles can have a groove-shaped U-section part, on the one hand, and flat legs sections that extend out on both sides, on the other hand. While the U-section parts ensure reinforcement to a particularly degree, the flat leg sections serve—aside from an additional stability function—also for problem-free attachment of the profiles to the mesh jacket. The U-section parts can have a maximum or front width of 10 mm to 50 mm, for example about 20 to 40 mm. The flat attachment flanges can have a width of 5 mm to 30 mm, for example about 10 to 20 mm. The U-section profiles preferably have a total width of 30 mm to 100 mm, for example 40 mm to 80 mm, for example about 40 to 70 mm.

The U-section profiles have a depth of 10 mm to 50 mm, for example, preferably 25 mm to 40 mm.

The U-section profiles can be further improved if the U-section profiles, which are produced from sheet-metal strips by forming, for example, are provided at their edges with bends that are turned toward the inside. In this way, the stability is increased further and, in particular, the risk of injury when handling the pallet container is reduced.

The U-section parts of the U-section profiles are preferably formed on two (planar) side sections and one bottom section that connects the side sections, so that these U-section parts have an essentially U-shaped basic shape, in total. In this connection, the bottom sections can be configured either as arc-shaped sections or also as flat or planar sections.

Optionally, it lies within the scope of the invention that the U-section profiles, for example their U-section parts, have pressed-in recesses distributed over the profile length, where these pressed-in recesses are formed into the sheet metal. In this way, the stability of the U-section profiles can be further increased. These pressed-in recesses can be provided in the case of different profile shapes.

The pallet container and therefore also the mesh outer jacket preferably have a rectangular base surface, so that the lattice jacket has four side walls. In general, the liner bag is provided with at least one outlet connector or one outlet opening, on which a shut-off organ is disposed. The mesh outer jacket consequently has a front wall assigned to the outlet opening and an opposite back wall, as well as two side walls that connect the front wall and the back wall with one another. In a preferred embodiment, at least two vertically extending U-section profiles are attached to the front wall, to the back wall, and to the side walls of the mesh outer jacket, in each instance, so that in total, preferably at least eight U-section profiles are attached to the mesh outer jacket. In a preferred further development, however, more U-section profiles are attached on the side walls, in each instance, than on the front wall and the back wall. Therefore it lies within the scope of the invention that two U-section profiles are attached to the front wall and/or the back wall, in each instance, while at least three, preferably four or more U-section profiles are attached to the side walls, in each instance. This configuration takes into account the fact that the shut-off organ is not supposed to be hindered by the reinforcement profiles, among other things.

A mesh outer jacket for a stackable container of the type described is also an object of the invention. The mesh outer jacket according to the invention, with the U-section profiles attached to it, is consequently also placed under protection separately.

BRIEF DESCRIPTION OF THE DRAWING

The above and other objects, features, and advantages will become more readily apparent from the following description, reference being made to the accompanying drawing in which.

DETAILED DESCRIPTION OF THE INVENTION

Figure 1:
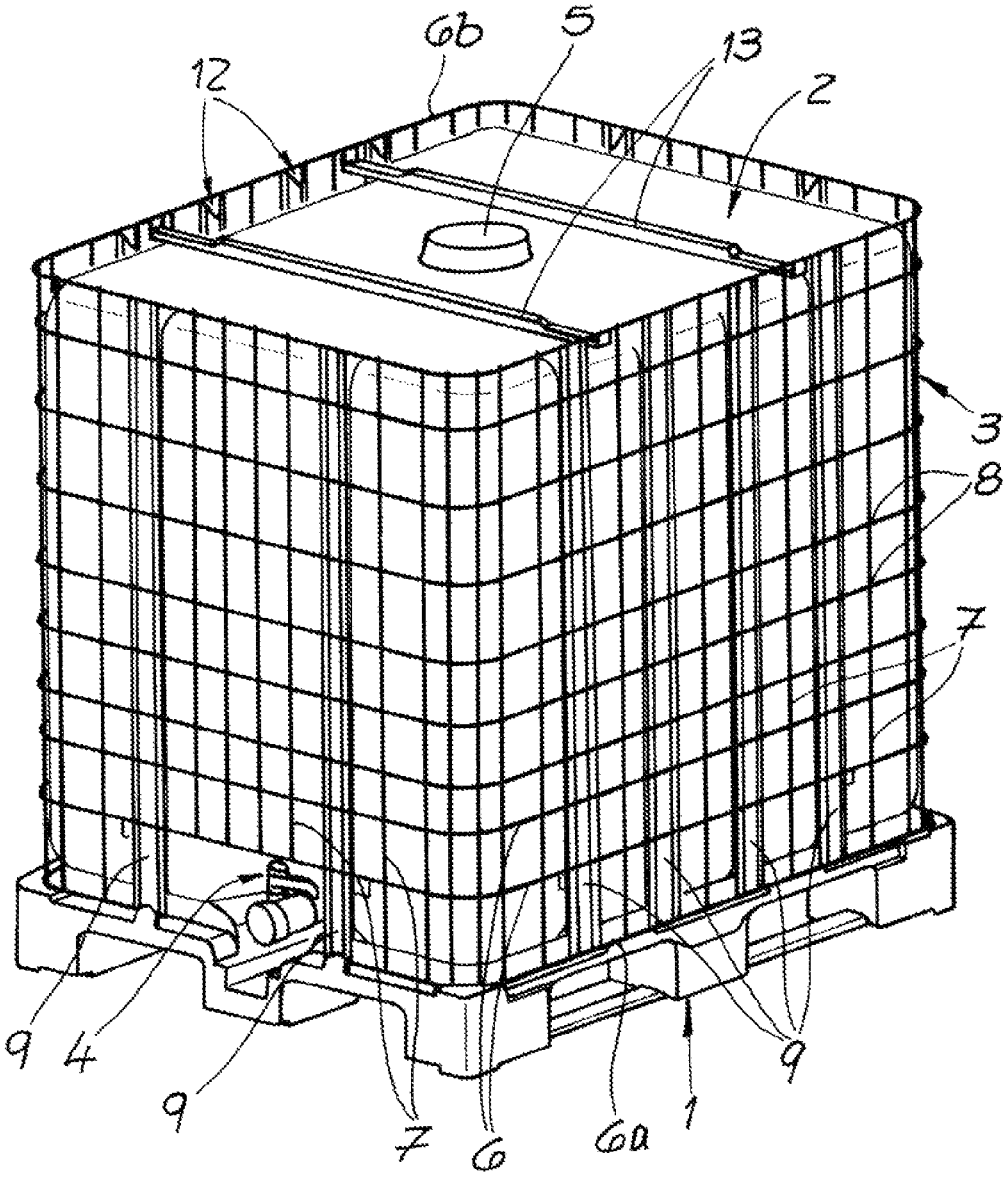
FIG. 1 is a perspective view of a pallet container according to the invention.

As seen in the drawing a stackable pallet container for transporting and/or storing liquids or bulk material basically is comprised of a rigid rectangular pallet 1 normally lying in a horizontal plane, a generally parallepipedal plastic liner bag 2 that sits on the pallet 1, and a mesh outer jacket 3 that surrounds the plastic liner bag and that forms four planar and vertical side walls connected at corners to have a rectangular shape as seen from above. FIG. 1 shows that the plastic liner bag 2 is provided with an outlet opening or connector having a valve 4 and an upper opening covered here by a large removable cap 5.

The mesh outer jacket 3 is made of horizontally running solid-steel lattice rods 6 and vertically extending solid-steel lattice rods 7 that are welded together at crossings 8. Preferably, such a mesh outer jacket 3 is produced from a steel mat or mesh.

Figure 2:
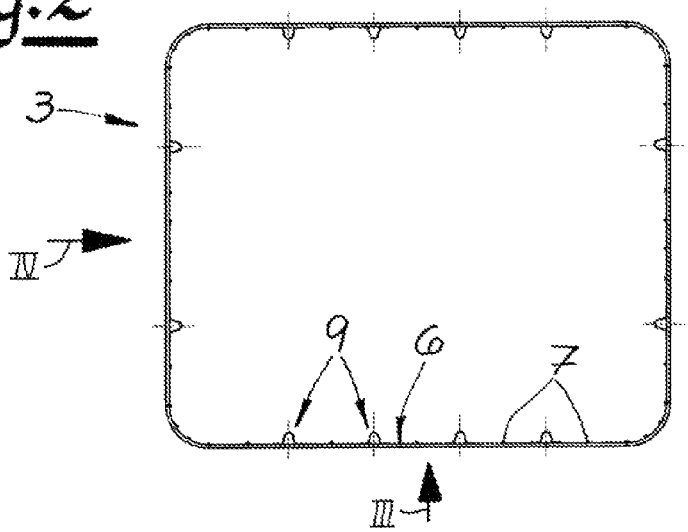
FIG. 2 is a top view of the reinforcement jacket of the container.
Figure 3:
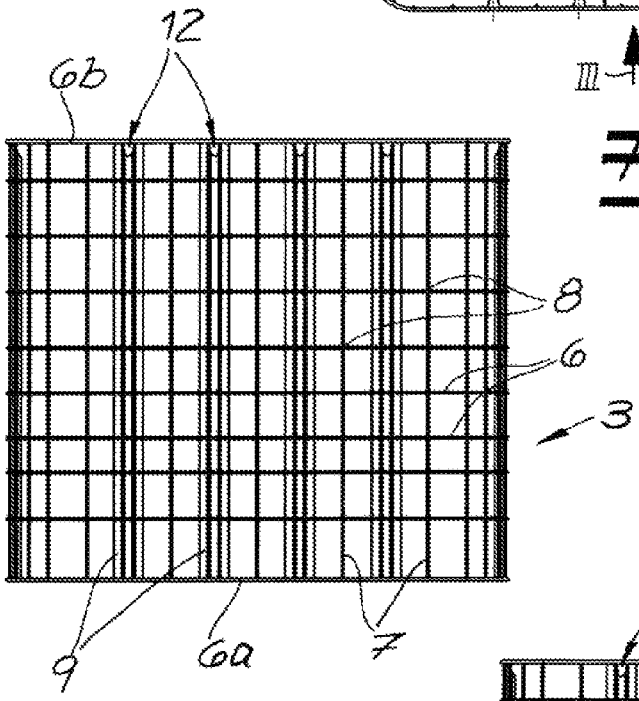
FIGS. 3 and 4 are views taken respectively in the directions of arrows III and IV of FIG. 2.
Figure 4:
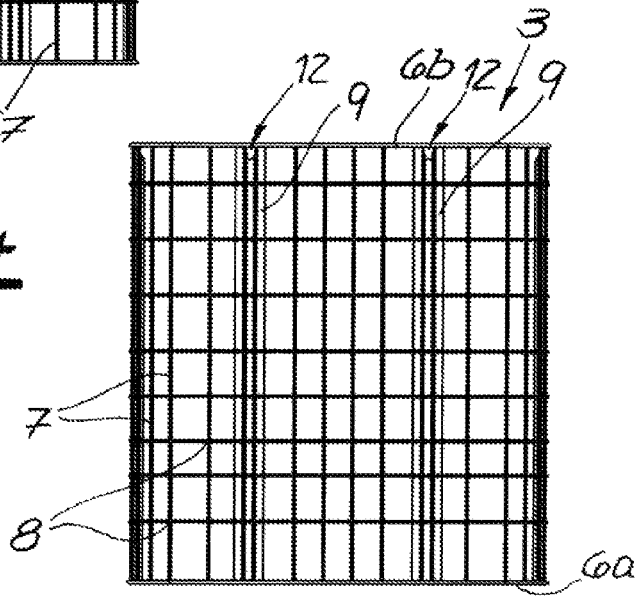
Figure 5:
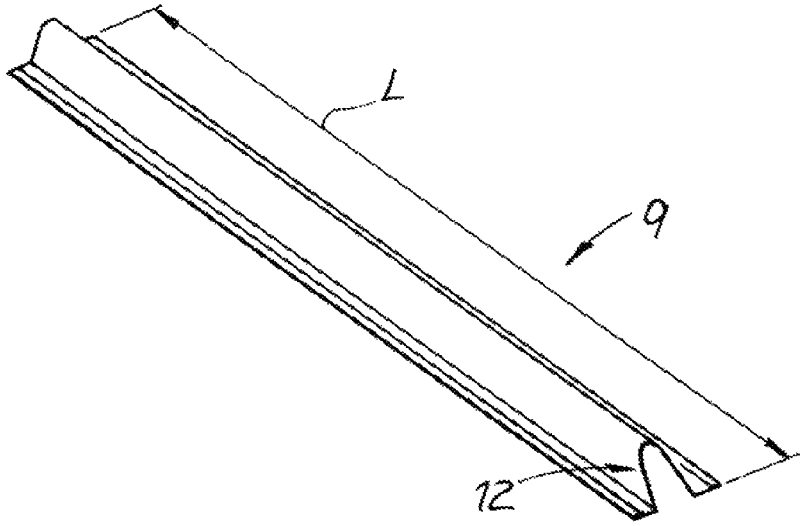
FIG. 5 is a perspective view of a reinforcement profile bar according to the invention.
Figure 6:
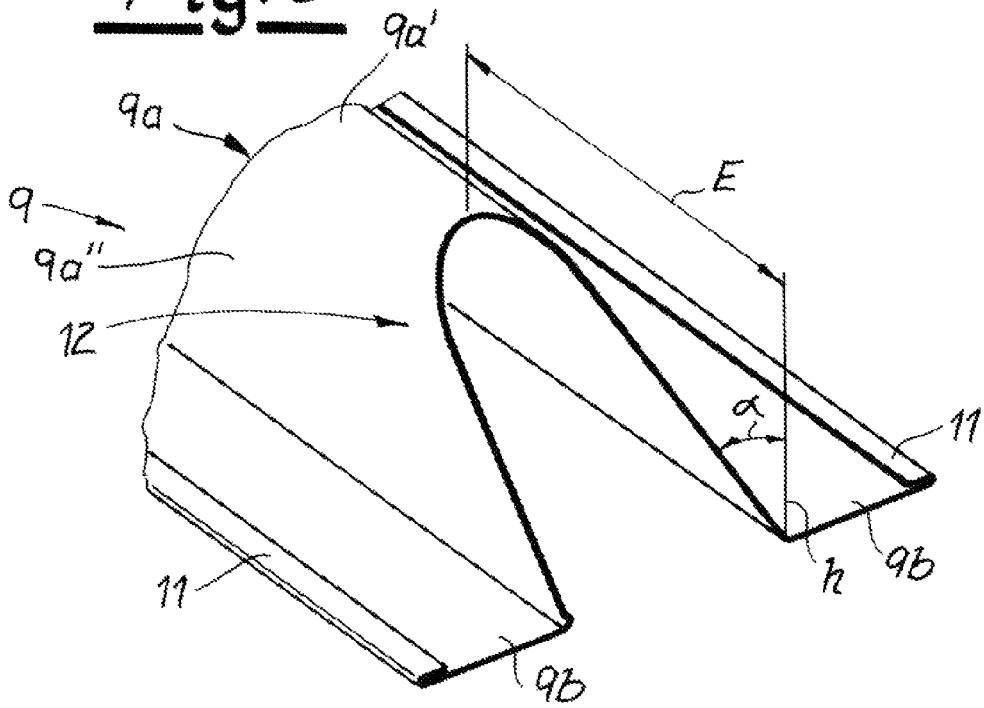
FIG. 6 is a large-scale view of the right end of the bar of FIG. 5.

In order to prevent bulging of the liner bag 2 after it has been filled and/or when it is stacked, the mesh outer jacket 3 is provided with vertically extending reinforcements on each of its side walls. According to the invention, these reinforcements are separate U-section profile bars 9 that are attached to the side walls formed by the mesh outer jacket 3. These separately produced U-section profiles 9 are shown in detail in FIGS. 5 to 7. FIGS. 2 to 4 show the mesh outer jacket with the reinforcement profiles attached to it.

The U-section profiles 9 are inside the jacket 3 and welded to the horizontal rods 6 of the mesh outer jacket 3 by welds on the inside, the horizontal lattice rods 6 being on the outside and the vertical lattice rods on the inside of the jacket 3. The U-section profiles 9 are attached to the mesh outer jacket 3 in such a manner that they project inward toward the liner bag 2 but are open outward. FIG. 1 shows how the plastic liner bag 2 itself is provided with groove-forming molded-in parts into which the U-section profiles 9 of the mesh outer jacket 3 engage. The mesh jacket 3 has first regions in which the vertical lattice rods 7 have a small horizontal spacing a and second regions in which the vertical lattice rods 7 have a second horizontal spacing b that is larger than the small spacing a. In this embodiment, the large spacing b amounts to at least twice, namely about three times the small spacing a.

Figure 7:
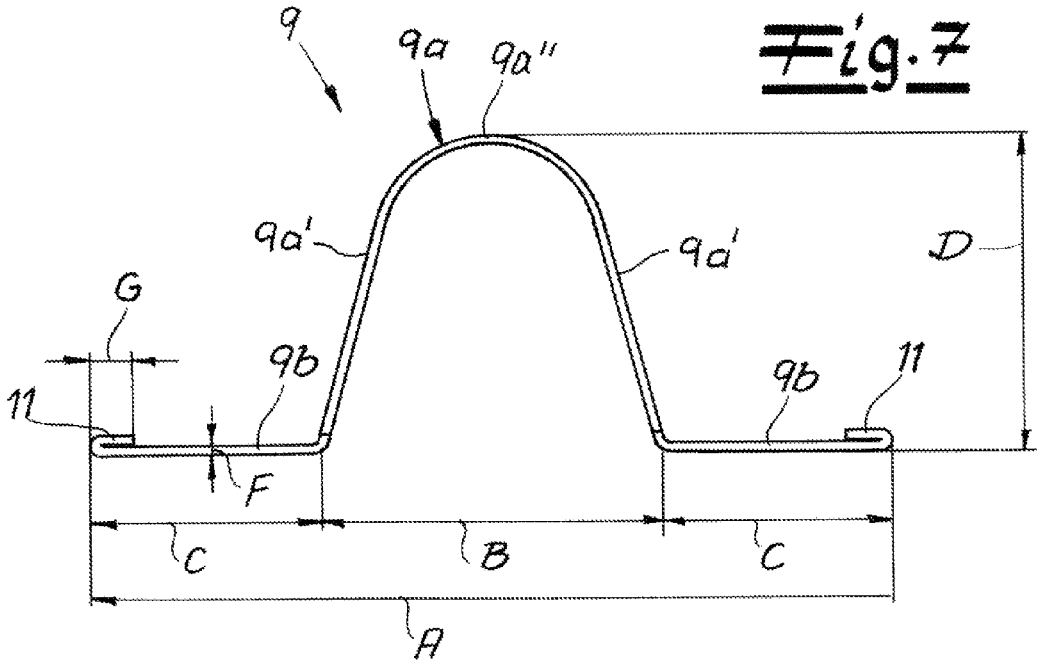
FIG. 7 is a large-scale end view of the bar.

The U-section profiles 9 have as shown in FIG. 7 a total width A that approximately corresponds to the small spacing a of the vertical lattice rods 6. In this connection, it can be seen in the figures that the U-section profiles 9 have a U-section center part 9*a* and planar flanges 9*b* projecting to each side in a common plane. The outer edges of flanges 9*b* are bent over at 11 toward the inside, that is toward the side from which the U-section part 9*a* projects.

According to the invention, the U-section profiles 9 are each formed at an upper end with an upwardly open U-shaped cutout 12 whose edge lies in a plane extending at an acute angle to the plane of the flanges 9*b*. Thus the cutout 12 of each profile 9 is deepest at the apex 9*a*" of the U-section part 9*a* and extends as mentioned in a plane along each of the legs 9*a*' of this part 9*a*. The purpose of these cutouts 12 is to guarantee that a second container can easily be fitted on top of and consequently stacked on the pallet container shown in FIG. 1. Thus the reinforcement profiled 9 with cutouts 12 according to the invention allow particularly stable stacking of the containers while in no way impairing their strength. To this end each profile 9 extends the full height of the jacket 3, that is from the lowermost rod 6*a* to the uppermost rod 6*b*, to which they are also welded.

As shown here the vertically extending U-section profiles 9 have a length L that corresponds to the height of the mesh jacket 3, here about 1000 mm. The edge of each cutout 12 extends at an angle $\alpha$ of about 55° relative to the horizontal h. The total depth E of the cutout 12 amounts to about 40 mm in this embodiment. The U-section profiles 9 are produced from sheet steel having a thickness F of about 0.8 mm. The U-section profiles 9 have a total width A of about 70 mm in the embodiment according to FIGS. 1 to 9, where the central U-section part 9*a* has a front width B of about 40 mm and the two lateral flat sections 9*b* each have a width C of about 20 mm. The bends 11 have a width G of about 4 mm. The depth D of these U-section profiles amounts to approximately 25 mm to 30 mm.

FIG. 1 further shows upper connecting profile bars 13 ling atop the bag 2 and extending across the upper end of the jacket 3.

The pallet container has a rectangular footprint, as does the mesh outer jacket 3. The mesh outer jacket 3 consequently forms a front side wall cut out at 6*c* for the outlet connector 4 and an opposite back wall, as well as two side walls that connect the front and back walls with one another. The drawings show that two of the U-section profiles 9 are attached to the front wall, and that two of the U-section profiles 9 are also attached to the back wall. Four of the U-section profiles 9 are attached to each of the two side walls. The U-section profiles 9 on the front wall and on the back wall consequently have a greater spacing from one another than on the side walls. This takes the fact into account that the U-section profiles are not allowed to hinder handling of the shut-off organ.

Figure 11:
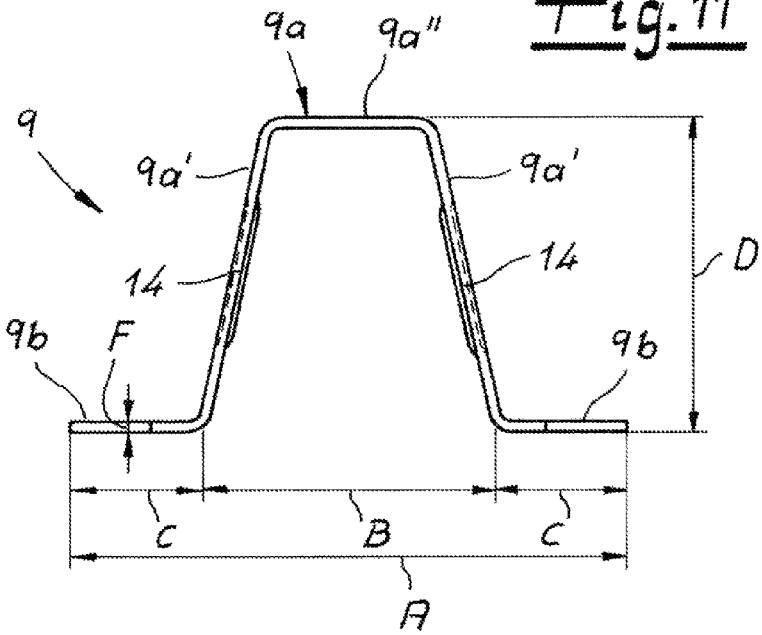
FIG. 11 is a large-scale end view of the FIG. 10 bar.
Figure 9:
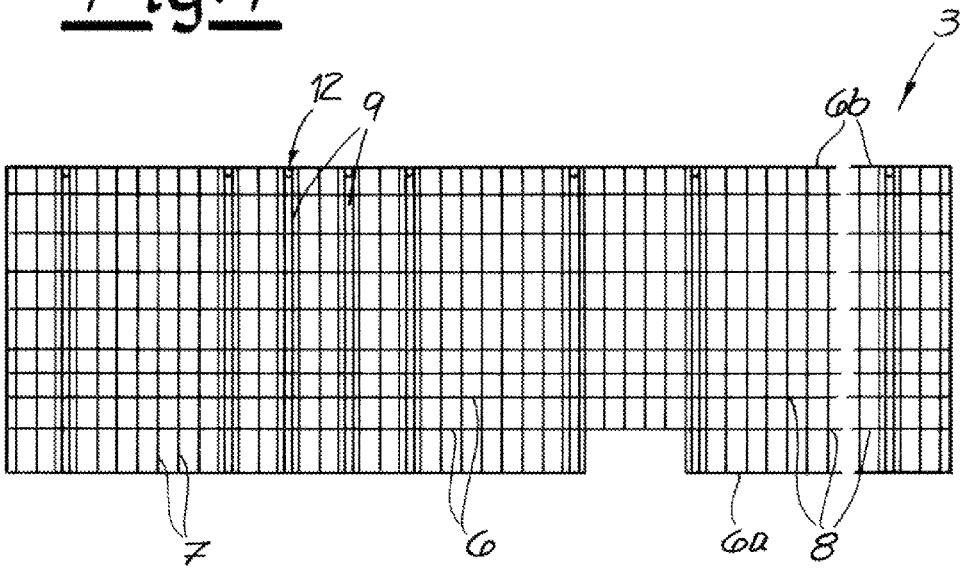
FIG. 9 is a view like FIG. 8, but with reinforcements.
Figure 10:
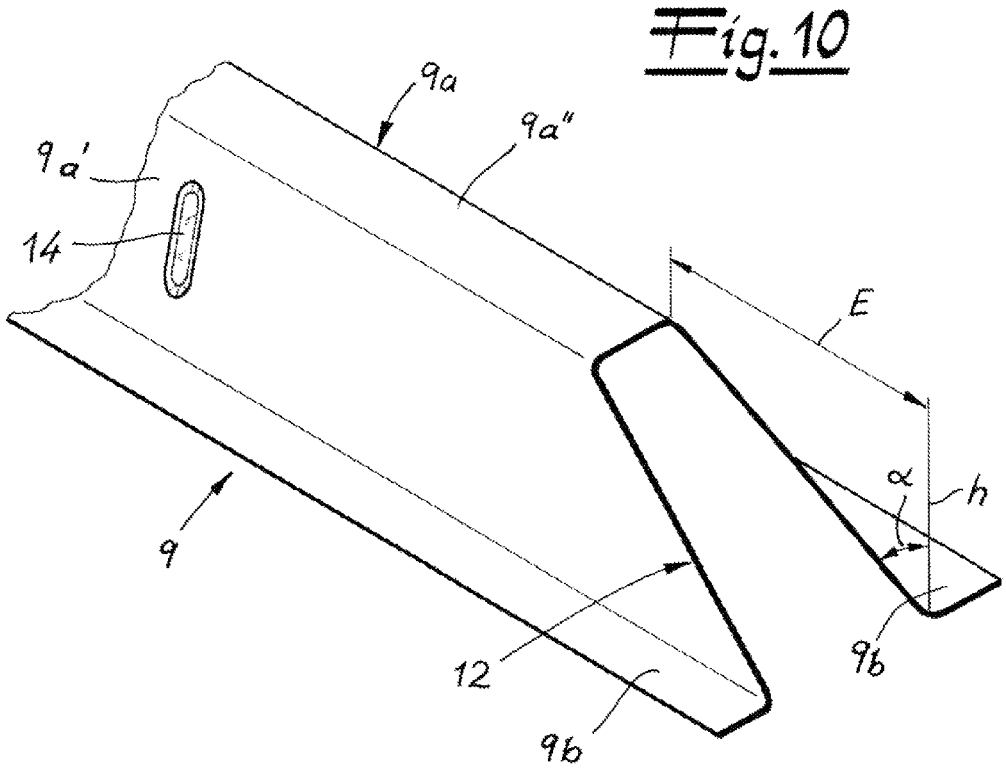
FIG. 10 is a view like FIG. 5 of another reinforcement bar according to the invention.

FIGS. 10 and 11 show an alternative embodiment of the U-section profile 9. The basic structure and the basic method of functioning of the U-section profiles according to FIGS. 10 and 11 correspond to the structure and function of the U-section profile 9 shown in FIGS. 1 to 9. The embodiment according to FIGS. 10 and 11 differs from the embodiment according to FIGS. 5 to 7 essentially in that the U-section part 9*a* is formed, in the case of all the embodiments, by two planar sides or legs 9*a*' and a planar apex 9*a*" that connects the legs 9*a*'. In the embodiment according to FIGS. 5 to 7, these apex 9*a*" is arcuate while the legs 9*a*' are flat or planar. However, there is always a basically U-shaped part 9*a*. In FIGS. 10 and 11, the angle α once again amounts to about 55°, and the total height E of the cutout 12 also amounts to 40 mm. However, the U-section profiles 9 have a smaller total width A of about 50 mm in the case of this embodiment, where the central U-section part 9*a* has a front width B of about 20 mm to 25 mm, and the two lateral flat sections 9*b* each have a width C of about 10 mm. The depth D of these U-section profiles amounts to approximately 25 mm to 30 mm.

FIGS. 10 and 11 also show recesses 14 be formed in the kegs 9*a*' of the U-section profile 9. A plurality of such recesses 14 are provided along the length of the profile, serving to increase the rigidity of the U-section profile 9. These pressed-in recesses 14 can be provided on both legs 9*a*', specifically preferably equidistant over the entire length of the U-section profile, where the recesses 14 on one of the legs 9*a*' are staggered relative to those on the other leg 9*a*'. This is not shown in the figures. Such recesses 14 can also be provided in the embodiments according to FIGS. 5 to 7.

Figure 8:
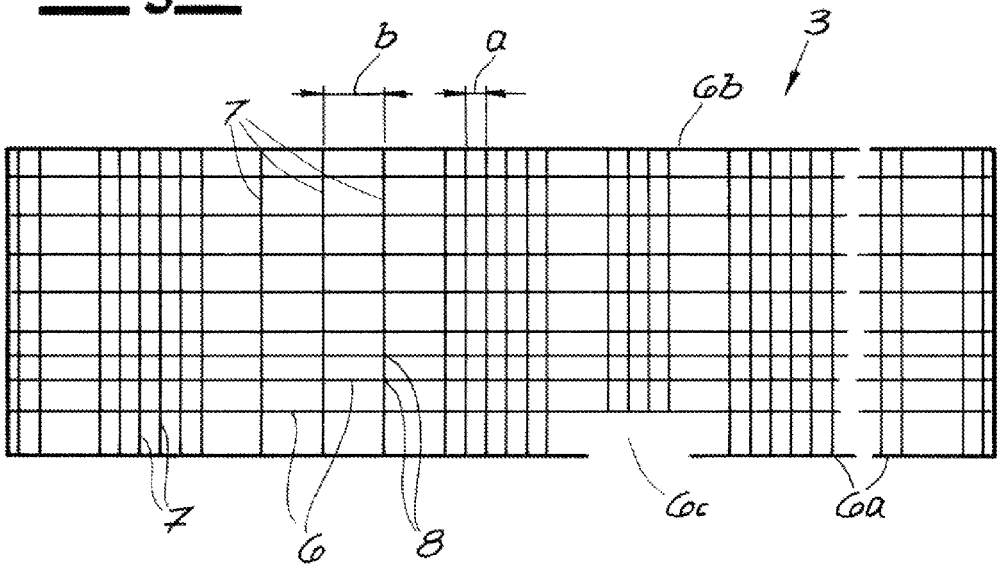
FIG. 8 is a developed view of the lattice side wall without reinforcements.

Furthermore, FIGS. 8 and 9 show that, to start with, an "irregular" lattice structure is produced with the different regions having the different spacings a and b between the vertical rods 7, in each of which regions the structure is basically uniform structure is formed, however, after attachment of the U-section profiles 9. Nonetheless no opening is left that is greater than 100 $cm^2$. This is the case in the regions with the small spacing a, and is also the case in the regions with the wide spacing b where the reinforcement bars 9 are provided, even though in the regions with the spacing b of the rods 7 the holes between the rods 6 and 7 would otherwise be greater than 100 $cm^2$.

We claim:

1. A stackable pallet container for transporting or storing fluent material, the container comprising:

a rigid pallet;

a plastic liner bag sitting on the pallet;

a mesh outer jacket surrounding the plastic liner bag, secured to the pallet, and forming with the pallet an upwardly open cavity containing the liner bag, the jacket being formed by horizontal rods and vertical rods joined at crossings; and at least partially U-section vertical reinforcement bars fixed inside the outer jacket and each having an upper end formed on a side directed inward toward the bag with a cutout.

2. The stackable pallet container defined in claim 1, wherein the cutouts are upwardly open.

3. The stackable pallet container defined in claim 1, wherein the reinforcement bars are welded to the horizontal rods.

4. The stackable pallet container defined in claim 1, wherein each reinforcement bar has an elongated U-section center part and a pair of coplanar attachment flanges extending oppositely from sides of the respective center part.

5. The stackable pallet container defined in claim 1, wherein each U-section center part has a pair of generally planar legs and an apex part bridging the legs.

6. The stackable pallet container defined in claim 5, wherein the apex part of each U-section part is planar or arcuate.

7. The stackable pallet container defined in claim 5, wherein each leg is formed with a plurality of pressed-in recesses.

8. The stackable pallet container defined in claim 5, wherein each attachment flange has a bent-over outer edge.

9. The stackable pallet container defined in claim 1, wherein each cutout has a depth of 10 mm to 100 mm.

10. The stackable pallet container defined in claim 1, wherein each cutout has an edge extending at an angle of 30° to 80° to the horizontal.

11. The stackable pallets container defined in claim 5, wherein each of the U-section parts has a horizontal depth measured perpendicular to the mesh jacket where the respective bar is attached of between 10 mm and 50 mm.

12. The stackable pallets container defined in claim 5, wherein each bar is made of sheet metal with a thickness of 0.5 mm to 2 mm.

13. The stackable pallets container defined in claim 5, wherein each of the U-section parts has a maximum width of 10 mm to 50 mm and each flange has a width of 5 mm to 30 mm.

14. The stackable pallets container defined in claim 5, wherein each of the bars has a width dimension measured across the respective flanges of 30 mm to 100 mm.

15. The stackable pallets container defined in claim 1, wherein the jacket has regions in which the vertical rods are set at a predetermined small spacing and regions in which the vertical rods are set at a predetermined large spacing equal to at least twice the small spacing.

16. The stackable pallets container defined in claim 15, wherein each reinforcement bar has a width equal generally to the small spacing.

17. The stackable pallets container defined in claim 16, wherein the rods and bars are spaced such that the mesh jacket has an opening size of at most 100 $cm^2$.

18. The stackable pallets container defined in claim 1, wherein the reinforcement bars are fixed to the horizontal rods in the regions where the vertical rods are at the large spacing.

19. The stackable pallets container defined in claim 18, wherein the reinforcement bars are in spaces between vertical rods that have no vertical rod.

20. The stackable pallets container defined in claim 1, wherein the bag is provided adjacent the pallet with an outlet connection, the mesh jacket being of generally rectangular footprint and forming a front wall at the outlet, a pair of parallel side walls projecting rearward from the front wall, and a rear wall parallel to the front wall and interconnecting rear edges of the side walls, the front and back walls each having two of the reinforcement bars and the side walls each having four of the reinforcement bars.

* * * * *